United States Patent [19]

Abe

[11] Patent Number: 4,629,051

[45] Date of Patent: Dec. 16, 1986

[54] COIN SORTING DEVICE

[75] Inventor: Hiroshi Abe, Tokyo, Japan

[73] Assignee: Asahi Seiko Kabushiki Kaisha, Tokyo, Japan

[21] Appl. No.: 706,758

[22] Filed: Feb. 28, 1985

[30] Foreign Application Priority Data

| | | | |
|---|---|---|---|
| Mar. 3, 1984 | [JP] | Japan | 59-30109[U] |
| Mar. 3, 1984 | [JP] | Japan | 59-30110[U] |
| May 29, 1984 | [JP] | Japan | 59-107529 |
| Jun. 7, 1984 | [JP] | Japan | 59-83645[U] |
| Oct. 2, 1984 | [JP] | Japan | 59-205613 |
| Oct. 2, 1984 | [JP] | Japan | 59-148524[U] |
| Oct. 2, 1984 | [JP] | Japan | 59-148525[U] |

[51] Int. Cl.[4] ..... G07F 5/02; G07F 3/02; G07D 5/02; G07D 5/10

[52] U.S. Cl. ..... 194/261; 194/287; 194/288; 194/325; 194/329; 194/332; 194/336; 194/339; 194/346; 194/351

[58] Field of Search ..... 194/99, 101, 102, 97 A, 194/97 B, 97 R, DIG. 15, DIG. 20, 1 D

[56] References Cited

U.S. PATENT DOCUMENTS

| | | | |
|---|---|---|---|
| 3,163,278 | 12/1964 | Roonsivell | 194/102 |
| 3,194,378 | 7/1965 | Greenwald | 194/97 R |
| 4,397,382 | 8/1983 | Branker | 194/1 D X |
| 4,515,263 | 5/1985 | Facto | 194/1 D |
| 4,550,818 | 11/1985 | Holliday | 194/1 D |

*Primary Examiner*—H. Grant Skaggs
*Assistant Examiner*—Jay I. Alexander
*Attorney, Agent, or Firm*—Parkhurst & Oliff

[57] ABSTRACT

A coin sorting device is designed to inhibit tampering with a coin operated machine by means of a wire, metal tape or the like, and to further prevent non-acceptable coins from being accepted by the coin-operated machine. The various embodiments of the device include a cancel mechanism for returning non-acceptable coins from a coin sorting passage to a coin return chute, a shutter movably arranged across the inlet of a coin acceptance chute for completely closing the inlet to prevent unauthorized operation, a non-acceptable coin block arm extruding into the inlet of the coin acceptance chute to block the inlet upon detection of a coin in the return chute, a coin hole engaging wire for detecting and engaging non-acceptable coins with center holes, a mill engaging arm with an engaging thin nail to detect and engage non-aceptable milled coins, and an electromagnetically operated blocker rotatable between a withdrawn position and a block position wherein the blocker extends into the inlet of the coin sorting passage across the coin inserting opening to prevent insertion of non-acceptable coins. The device is advantageous for preventing tampering and operation with non-acceptable coins, is capable of being inexpensively mass produced, and is high in quality.

13 Claims, 32 Drawing Figures

COIN SORTING DEVICE

BACKGROUND OF THE INVENTION

1. Field of the Invention

The present invention relates to coin sorting devices used in automatic vending machines, coin operated gaming machines and the like.

2. Description of the Prior Art

Heretofore, a front type coin sorting device as disclosed in U.S. Pat. No. 4,376,480 has generally been used as one of such coin sorting devices. This front type coin sorting device, as disclosed in the above U.S. patent, comprises a front plate provided with an opening at the upper portion thereof for insertion of a coin, and a return opening at the lower portion thereof; a stationary side plate fixed to the back surface of the front plate; a movable side plate hingedly connected to and spaced sidewardly from the stationary side plate to define a coin sorting passage therebetween with a coin diameter sorting cradle and a coin material sorting means; a chute side plate secured to and spaced sidewardly from the stationary side plate to define a coin acceptance chute and a return chute therebetween by bifurcating the coin sorting passage; whereby the diameter and the material of a coin inserted through the inserting opening is checked during passing of the coin through the sorting passage, and further whereby an acceptable coin is passed into the coin acceptance chute from the outlet of the coin sorting passage and is accepted once the coin actuates a microswitch actuating arm to produce a coin acceptance signal at the lower end of the coin acceptance chute, while a non-acceptable coin is passed into a return chute at the branch point from the coin sorting passage and is returned to the return opening at the outlet of the return chute.

The above-mentioned coin sorting device has a high quality sorting function and is simple in construction for assembly into automatic vending machines and the liker.

SUMMARY OF THE INVENTION

An object of the present invention is to improve the coin sorting device, including provision of a diameter sorting cradle.

Another object of the present invention is to inhibit tampering with the above type of coin sorting device and to provide a simple and reliable coin sorting device arranged such that the assembly and adjusting operations can be readily carried out.

According to the present invention, the coin sorting device comprises a front plate provided with an opening at the upper portion thereof for insertion of a coin, and a return opening at the lower portion thereof; a stationary side plate fixed to the back surface of the front plate; a movable side plate hingedly connected to and spaced sidewardly from the stationary side plate to define a coin sorting passage therebetween with a coin diameter sorting cradle and a coin material sorting means; a chute side plate secured to and spaced sidewardly from the stationary side plate to define a coin acceptance chute and a return chute therebetween by bifurcating the coin sorting passage, whereby the diameter and material of a coin inserted through the inserting opening are checked during passing of the coin through the sorting passage, and further whereby an acceptable coin is passed into the coin acceptance chute from the outlet of the coin sorting passage and is accepted once the coin actuates a microswitch actuating arm to produce a coin acceptance signal at the lower end of the coin acceptance chute, while a non-acceptable coin is passed into a return chute at the branch point from the coin sorting passage and is returned to the return opening at the outlet of the return chute. The device further comprises a shutter movably arranged between the stationary side plate and the chute side plate for closing the inlet of the coin acceptance chute. The shutter having an actuating arm adapted to be engaged with a coin passing in the coin acceptance chute; a microswitch lock lever for locking the microswitch actuating arm so as not to actuate the microswitch; a releasing arm on the shutter for releasing the microswitch lock lever at a chute inlet closed position of the shutter; a non-acceptable coin block arm pivoted on the chute side plate for blocking the inlet of the coin acceptance chute; an actuating member having a coin detecting arm located at the bottom of the return chute and a block actuating arm for extruding the block arm into the inlet of the coin acceptance chute when the coin detecting arm detects a coin in the return chute.

According to another embodiment of the invention, the coin sorting device comprises a coin sorting passage extending from a coin inserting opening between two side plates and a counter-balanced coin diameter sorting cradle pivoted on a pivot pin on one of the side plates for sorting the diameters of coins, the cradle being rotatably and removably supported on the pivot pin. The device further comprises a retainer arm which is openably hinged at the upper end to the side plate and has a retainer head for capping the outer end of the pivot pin to prevent the cradle from falling off the pivot pin.

BRIEF DESCRIPTION OF THE DRAWINGS

Other objects and advantages are more particularly set forth in the following detailed description and in the accompanying drawings, in which.

DETAILED DESCRIPTION OF THE PREFERRED EMBODIMENTS

Figure 1:
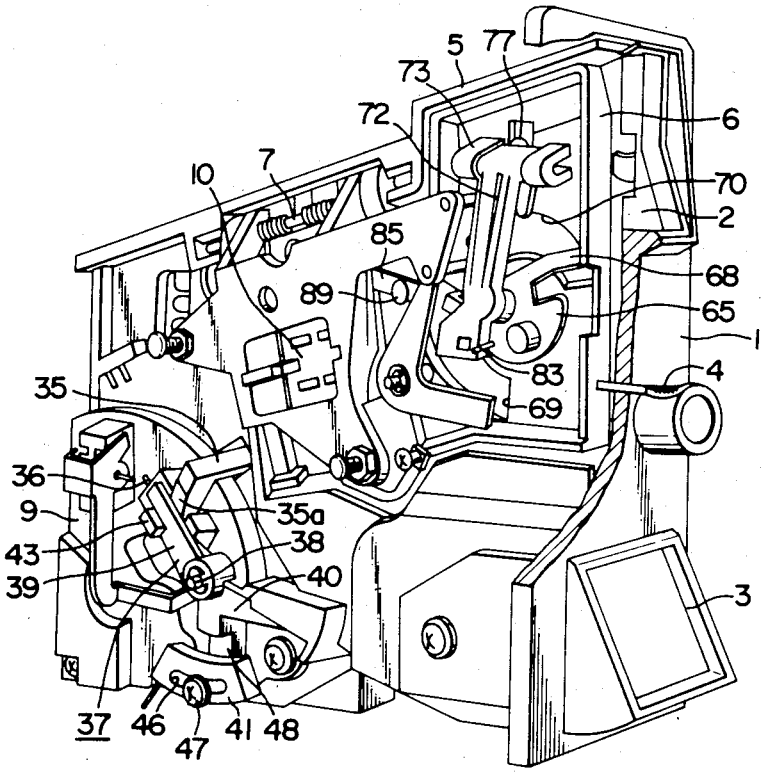
FIG. 1 is a broken left side perspective view of the coin sorting device according to the present invention.
Figure 2:
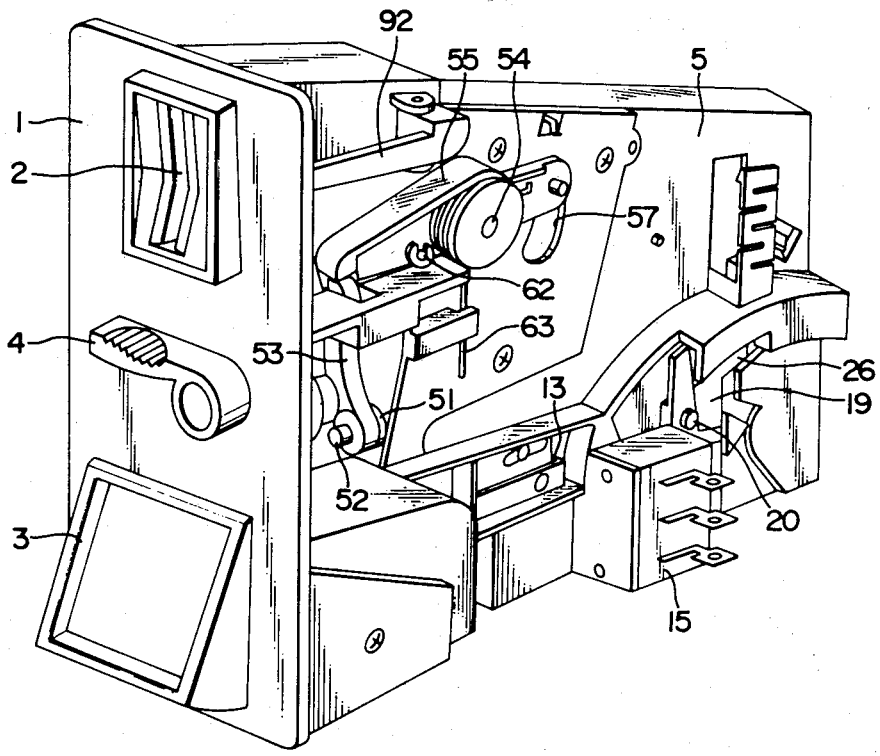
FIG. 2 is a right side perspective view of the coin sorting device of FIG. 1.
Figure 3:
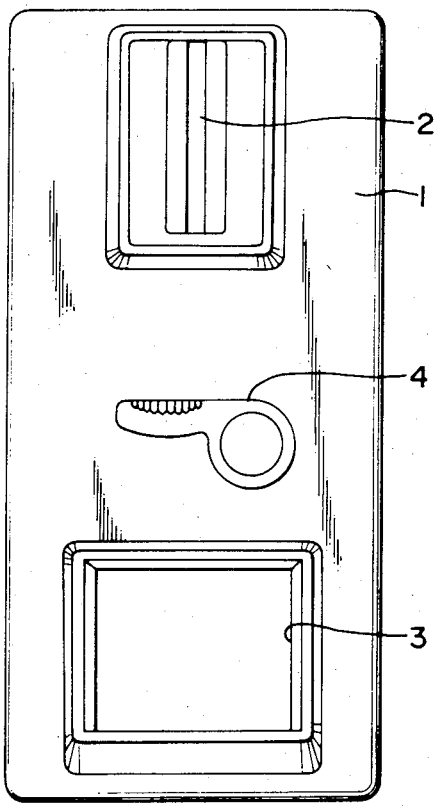
FIG. 3 is a front elevational view of the coin sorting device of FIG. 1.

The present invention will be described in reference to the accompanying drawings.

In the drawings, the reference numeral 1 designates a front plate which has a coin inserting opening 2 at the upper portion, a return opening 3 at the lower portion and a returning lever 4 pivoted on the front plate at the mid-position between the coin inserting opening 2 and the return opening 3.

Figure 9:
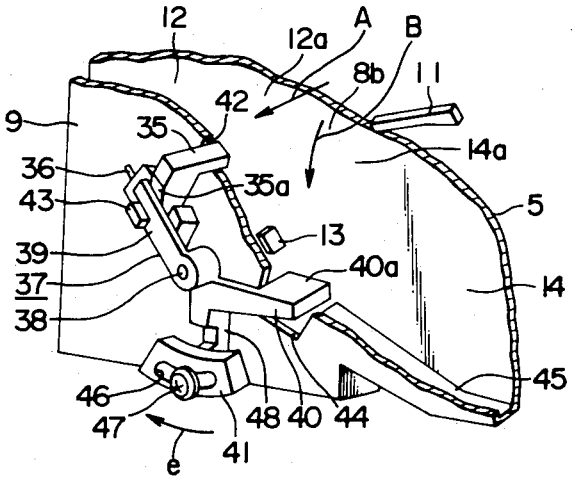
FIG. 9 is a broken perspective view showing the branching portion of the coin acceptance chute and the return chute from the outlet of the coin sorting passage.
Figure 31:
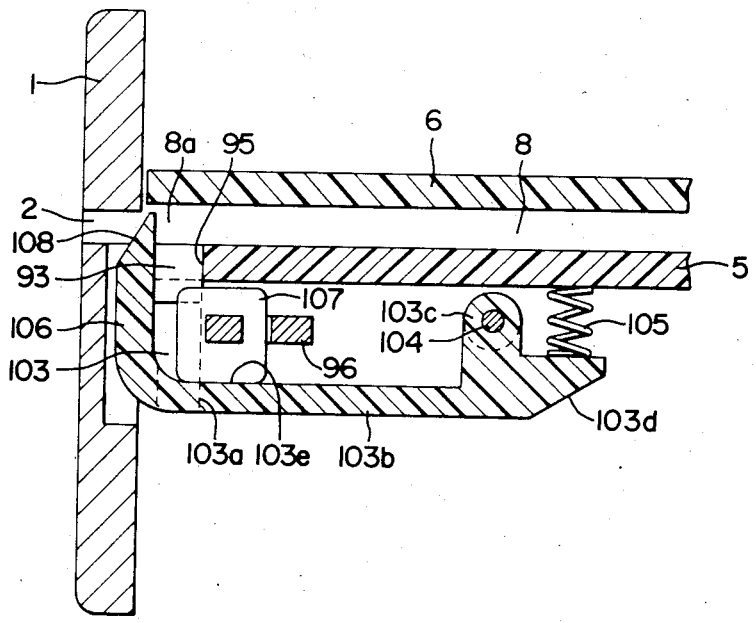
FIG. 31 is a sectional view taken along line XXXI—XXXI of FIG. 28.
Figure 32:
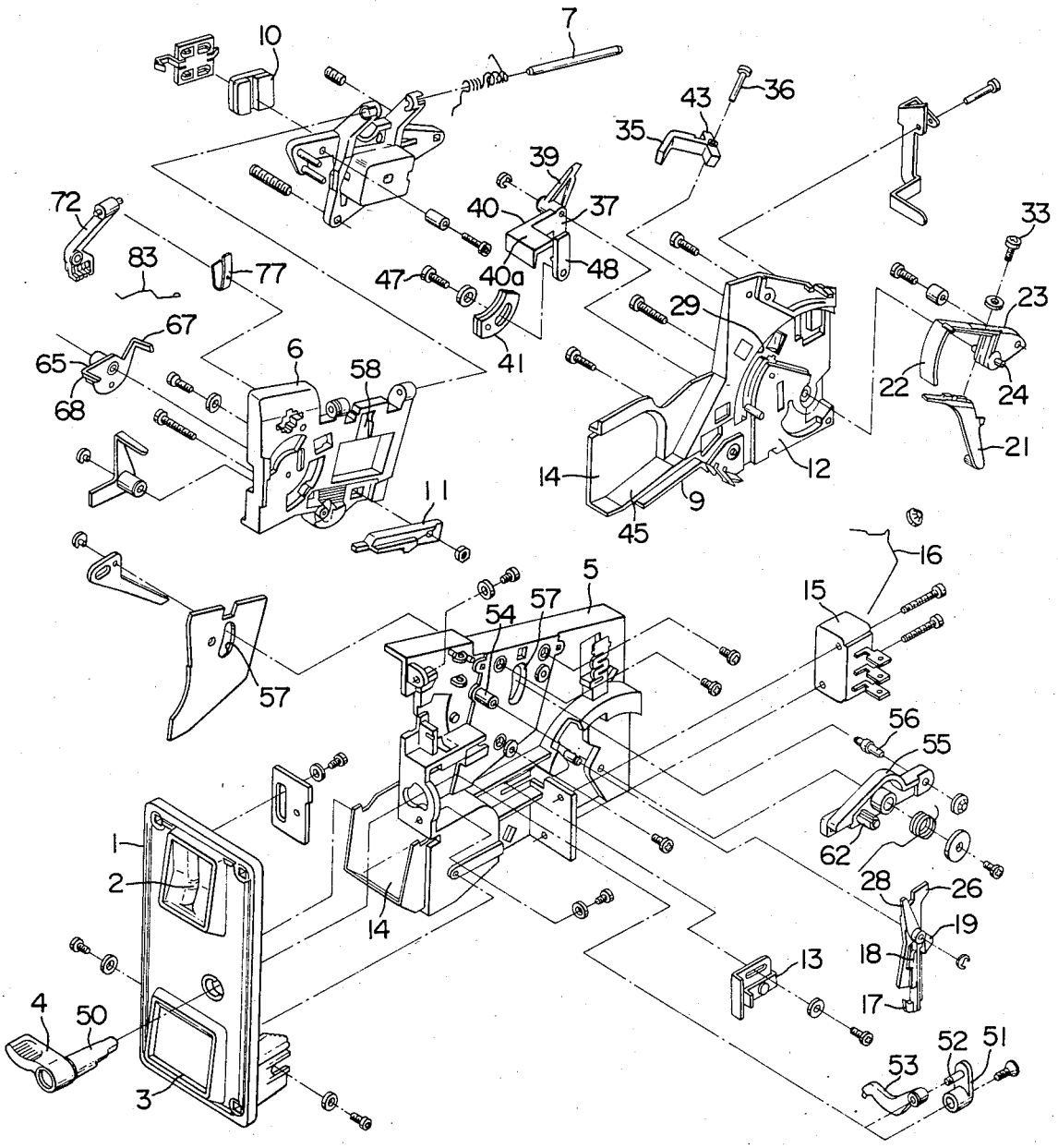
FIG. 32 is an exploded perspective view of the coin sorting device of FIG. 1.

A stationary side plate 5 is fixed to the back surface of the front plate 1 by screws or the like and a movable side plate 6 is hingedly connected to the stationary side plate 5 by means of a hinge pin 7. The stationary side plate 5 and the movable side plate 6 are spaced parallel to each other to provide a coin sorting passage 8 therebetween. The passage 8 receives at the inlet end **8*a* thereof a coin inserted through the coin inserting opening 2 in the front plate 1 (FIG. 31). A chute side plate 9 is secured, in a parallel spaced apart relation, to the stationary side plate 5 by means of a screw or the like to provide therebetween a coin acceptance chute 12 and a return chute 14 which is extended to the return opening 3 in the front plate 1. The coin sorting passage 8, coin acceptance chute 12 and return chute 14 are arranged in a well known manner so that the inserted coin is subjected to a magnetic braking force by a material sorting magnet 10 during rolling on a rail 11 in the coin sorting passage 8. Thus, an acceptable coin is passed from the outlet 8*b* of the passage 8 into the coin acceptance chute 12, as shown by arrow "A" (FIG. 9), while a non-acceptable coin is passed toward the return side of a coin deflector 13 from the outlet 8*b* of the passage 8 into the return chute 14**, as shown by arrow "B" (FIG. 9).

The three side plates 5, 6 and 9 are molded with a rigid synthetic resin. The acceptance chute 12 is provided at the lower end outlet **12*b* thereof with a microswitch 15 having a switch actuating arm 16, the arm end 16*a* extending across the outlet 12*b* (FIGS. 5 and 6) to be operated by the acceptable coin passing through the outlet of the acceptance chute 12 into a coin box (not shown) placed under the outlet 12*b* so as to produce a coin acceptance signal. The non-acceptable coin, which is rejected into the return chute 14, is returned toward the return opening 3**.

Figure 7:
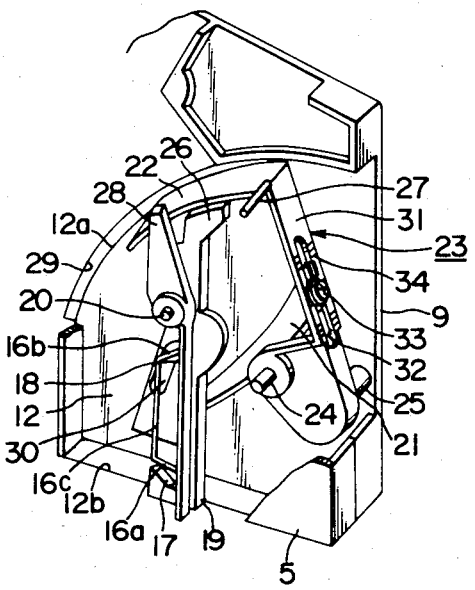
FIG. 7 is a broken perspective view showing the inner portion of the coin acceptance chute.

Referring to FIG. 7 rotatably connected to, the chute side plate 5 of the acceptance chute 12 and pivoted at a pivot pin 20 is a microswitch lock lever 19 having an engaging leg 17 and a shoulder 18 formed in an elongated slot to prevent the microswitch actuating arm 16 from being actuated by a wire inserted from the return opening 3 through the return chute 14. The lock lever 19 is rockable between a lock position (FIG. 7), for preventing the actuating arm from being actuated, wherein end portions **16*a* and 16*b* of the actuating arm 16 are engaged with engaging leg 17 and shoulder 18, respectively, and a release position (FIG. 8) for permitting the actuating arm to be actuated by the acceptable coin. A shutter 23 is pivoted at a pivot pin 24 between the side plates 5 and 9. The shutter 23 has an actuating arm 21 adapted for engaging with a coin passing in the acceptance chute 12, and a shutter plate 22 for closing the inlet 12*a* of the acceptance chute 12 such that the acceptable coin passed into the acceptance chute 12 engages with the actuating arm 21 to rotate the shutter so that the shutter plate 22 moves across the inlet 12*a* of the acceptance chute 12 and closes it. The shutter 23 is usually held in an open position wherein the shutter plate 22 is retracted to open the inlet 12*a* by means of a balance weight 25 and the balance action of the actuating arm 21. At the open position of the shutter 23, the lower surface of the shutter plate 22 is engaged with an engaging arm 26 of the lock lever 19 to prevent it from rotating to the release position from the lock position. In the closed position of the shutter 23, the acceptance chute inlet 12*a* is completely closed by the shutter plate and an engaging pin 27 on the shutter plate 22 is engaged with another engaging arm 28 of the lock lever 19 to rotate the lever 19 into the release position by a further rotation of the shutter 23** past the closed position.

With the above construction, when the inlet **12*a* of the acceptance chute 12 is not completely closed by the shutter plate 22 of the shutter 23, both ends 16*a*, 16*b* of the actuating arm 16 of the microswitch 15 are engaged with the leg 17 and the shoulder 18 of the lock lever 19 to lock the actuating arm 16**.

The condition where the actuating arm is permitted to rotate about the shaft **16*c*, at the midpoint between both ends 16*a* and 16*b* so as to actuate the microswitch, is produced only when an acceptable coin passes into the acceptance chute 12. In such case, the acceptable coin passed into the acceptance chute 12 is engaged with the actuating arm 21 of the shutter 23. Thus, the shutter 23 is rotated about the pivot pin 24 so as to move the shutter plate 22 across the inlet 12*a* of the acceptance chute 12 with both edges of the shutter plate 22 being engaged in a pair of arch-shaped guide grooves 29 in the side plates 5, 9 to close the inlet 12*a*. Thereafter, the engaging pin 27 and the engaging pin 28 engage each other to thereby rotate the lock lever 19 about the pivot pin 20** into the release position (FIG. 8).

In this release position of the lock lever 19, the end portions 16a, 16b of the microswitch actuating arm 16 are disengaged from the leg 17 and the shoulder portion 18 in a slot 30, respectively, and move freely in the slot 30 so that the acceptable coin can actuate the actuating arm 16 and pass through the outlet 12b into the coin box.

Thus, the microswitch actuating arm 16 can be actuated only when the inlet 12a of the acceptance chute 12 is completely closed by the shutter plate 22. Under such closed condition, neither a wire nor a thin metal tape could be inserted into the acceptance chute 12 through the inlet 12a. Accordingly, the coin sorting device completely prevents unfair operation by means of a wire, metal tape or the like inserted through the inlet 12a.

Figure 8:
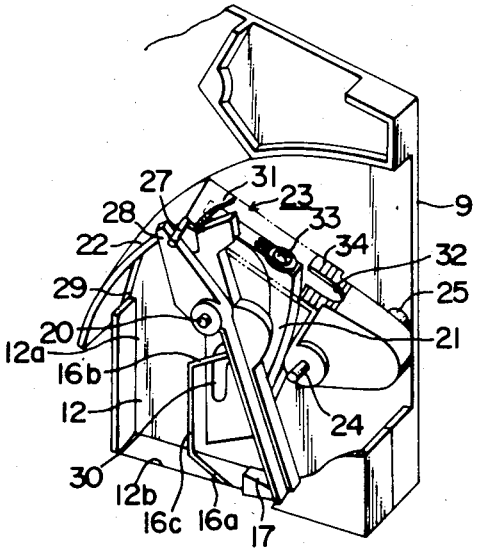
FIG. 8 is a broken perspective view for illustrating operation of the shutter gate in the coin acceptance chute.

In the illustrated embodiment, the actuating arm 21 is secured to an arm portion 31 of the shutter 23 by means of a slot 32 and a screw 33 so as to adjust the distance between the actuating arm 21 and the shutter plate 22 corresponding to the diameter of the coin to be sorted so that the shutter 23 can be rotated to the closed position by the coin, as shown in FIG. 8. The arm portion 31 is provided with a scale 34 corresponding to different diameters of coins, for example 21 mm–31 mm.

Figure 4:
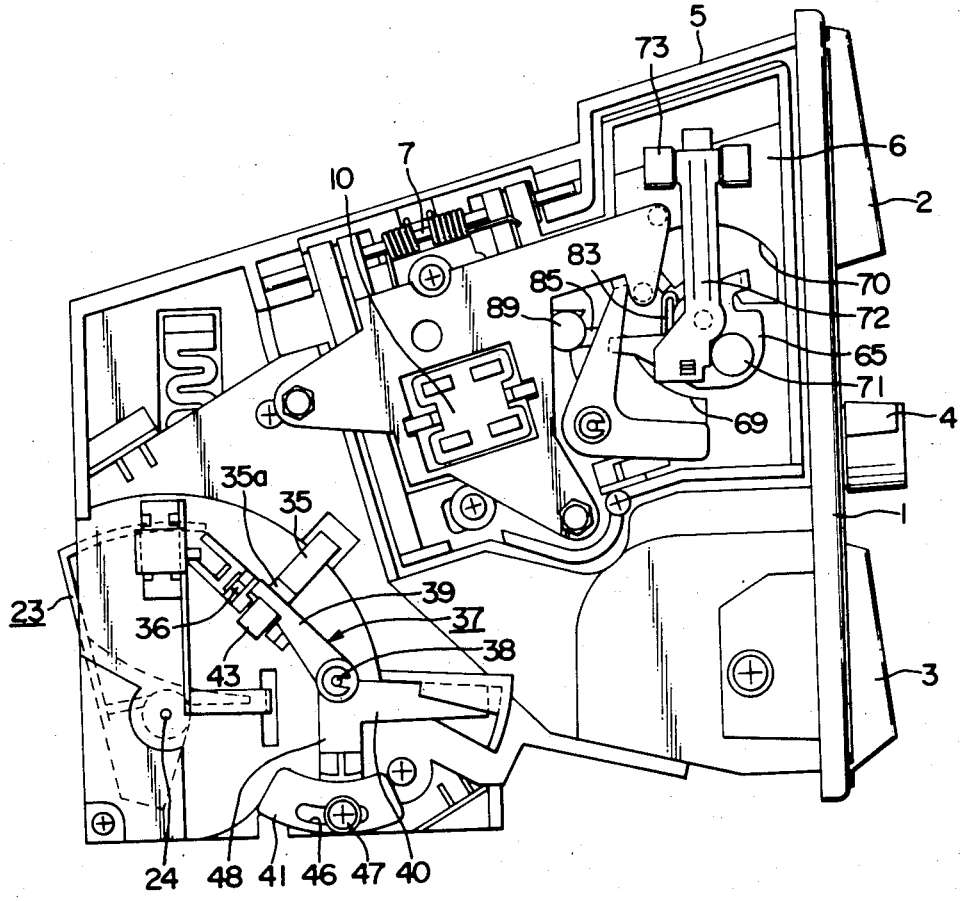
FIG. 4 is a left side elevational view of the coin sorting device of FIG. 1.

Referring to FIGS. 1, 4 and 9, a non-acceptable coin block arm 35 is pivoted to the chute side plate 9 by means of a pivot pin 36 so as to be rockable to a position where it is blocking inlet 12a of the acceptance chute 12 from a position where it is retracted from the chute 12, and a block arm actuating lever 37 is pivoted to the chute side plate 9 by means of a pivot pin 38. The actuating lever 37 is provided with an actuating arm 39 which engages with a sloped surface 35a of the block arm 35. A non-acceptable coin detecting arm 40 extends to the return chute 14 through a window 44 in the chute side plate 9 adapted to be actuated by a non-acceptable coin in the return chute 14. A balance weight is provided for maintaining the actuating lever 37 in the position as shown in FIG. 9, and for operating it when the device is tilted in the front or rear direction, as described below.

The block arm 35 is "L" shaped and rotatable about a pivot pin 36 so as to extrude the bent end portion 35b into the acceptance chute 12 at the inlet 12a thereof through an opening 42 in the chute side plate 9 when the actuating lever 37 is rotated about the pivot pin 38 so as to slide the actuating arm 39 on the sloped surface 35a from the normal position engaged with the end stop 43 on the block arm 35. In that position, the end portion 35b of the block arm 35 is retracted from the acceptance chute 12.

The non-acceptable coin detecting arm 40 has a movable chute bottom plate 40a at its free end which is extruded into the return chute 14 through the window 44 in the chute side plate 9. The movable chute bottom plate 40a is usually lifted up from the bottom 45 of the return chute 14 by the action of the balance weight 41 (FIG. 9). This balance weight 41 is adjustably fixed to a third arm 48 of the actuating lever 37 by means of a slot 46 and a screw 47.

With the construction mentioned above, the actuating lever 37 is normally maintained in the balanced position, as shown in FIG. 9, by the balance weight 41. In this balanced normal position, the actuating arm 39 is engaged with the stop 43 on the block arm 35 and its end portion 35b is retracted from the acceptance chute 12, and the movable bottom plate 40a at the free end of the detecting arm 40 is lifted up from the sloped bottom 45 of the return chute 14.

In such normal position, an acceptable coin, such as a nickel, subjected to a low magnetic braking force, can pass into the acceptance chute 12 through the inlet 12a from the rail 11 in the coin sorting passage 8, as shown by arrow "A" in FIG. 9.

A non-acceptable coin subjected to a high magnetic braking force can be deflected by the deflector 13 to pass into the return chute, as shown by arrow "B" in FIG. 9, and can be rolled onto the sloped bottom 45 to the return opening 3 after depressing the movable bottom plate 40a at the free end of the detecting arm 40.

Figure 10:
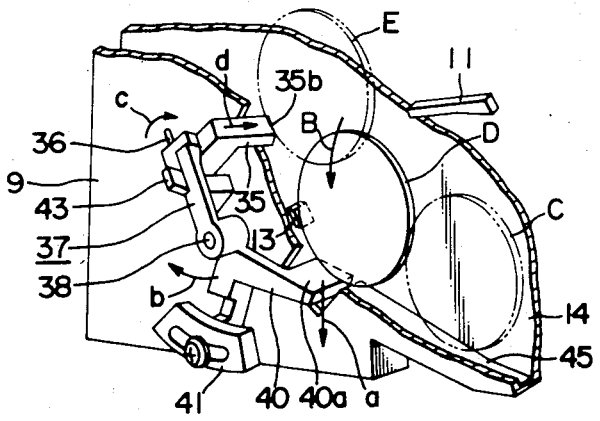
FIG. 10 is a broken perspective view for illustrating operation of the non-acceptable coin blocking arm and the actuating member of FIG. 1.

When the coin sorting device is operated in a manner such that a number of non-acceptable coins are inserted through the coin inserting opening 2, while the return opening 3 is closed to fill the return chute 14 with the non-acceptable coins, as shown by "C" in FIG. 10, so as to pass the non-acceptable coins into the acceptance chute 12 after the return chute 14 has filled up with coins, the last coin "D" in the return chute 14 depresses the movable bottom plate 40a, as shown by arrow "a" in FIG. 10, to rotate the actuating lever 37 about the pivot pin 38, as shown by arrow "b", and then the actuating arm 39 is displaced on the sloped surface 35a of the block arm 35 to rotate the block arm 35, as shown by arrow "c", to thereby extrude the end portion 35b of the block arm 35 into the acceptance chute 12 at its inlet 12a, as shown by arrow "d". Thus, the non-acceptable coin "E" inserted after the coin "D" is prevented from passing into the acceptance chute.

In another case where automatic vending machines, game machines or the like are tilted in a direction such that the magnetic braking action of the material sorting means is nullified, the slope detecting balance weight 41 is displaced in the direction shown by arrow "e" to rotate the actuating lever 37 in the direction shown by arrow "b" in FIG. 10. Thus, the end portion 35b of the block arm 35 is extruded into the acceptance chute 12 at the inlet 12a, to prevent the non-acceptable coin from passing into the acceptance chute 12 in the same manner as mentioned above.

Figure 5:
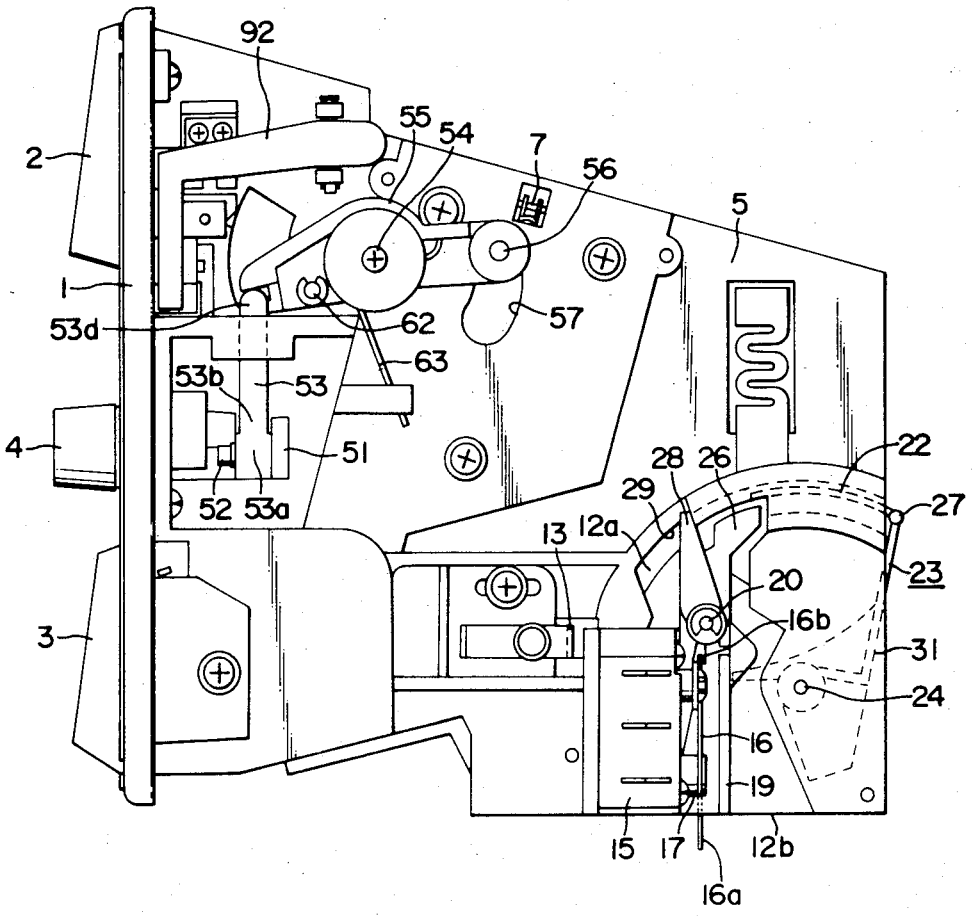
FIG. 5 is a right side elevational view of the coin sorting device of FIG. 1.
Figure 6:
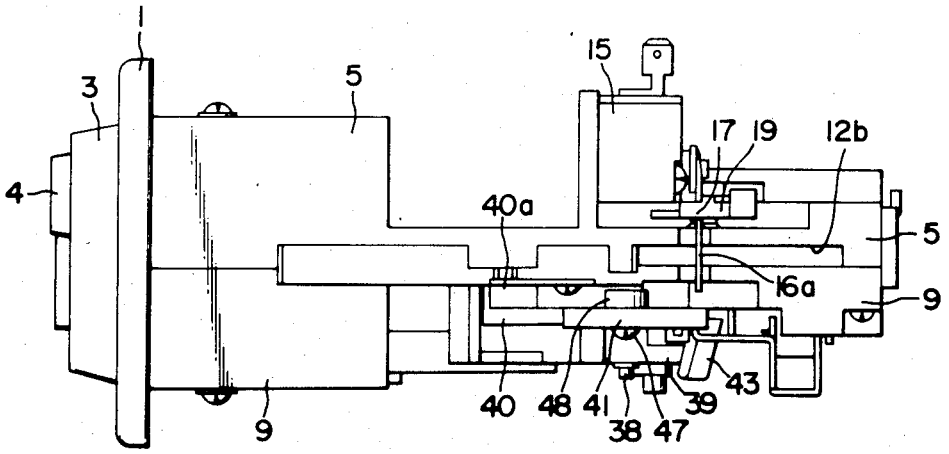
FIG. 6 is a bottom view of the coin sorting device of FIG. 1.
Figure 12:
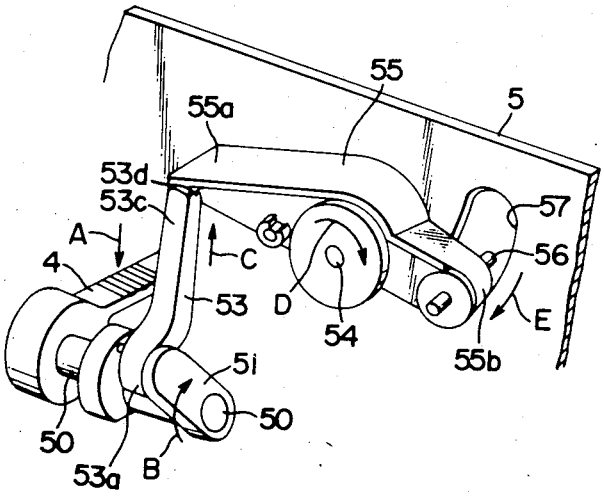
FIG. 12 is a perspective view for illustrating operation of the lever mechanism of FIG. 11.
Figure 13:
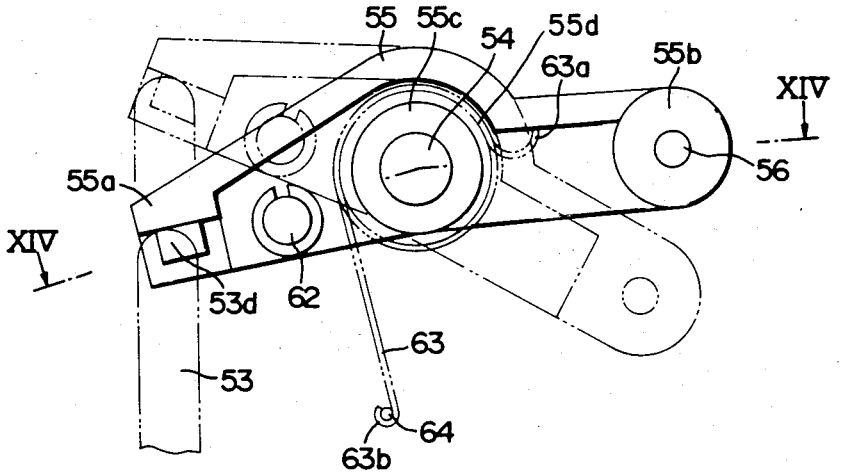
FIG. 13 is a side elevational view of the transmitting lever of the lever mechanism of FIG. 11.
Figure 14:
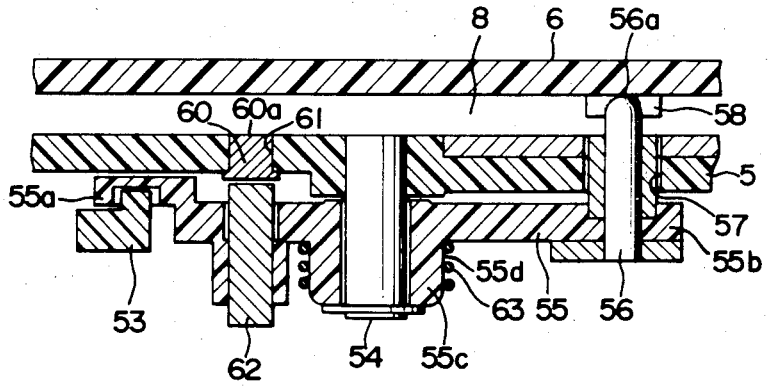
FIG. 14 is a sectional view taken along line XIV—XIV of FIG. 13.

Referring to FIGS. 5 and 11–14, there is illustrated a cancel mechanism including the returning lever 4 and means for returning a non-acceptable coin to be cancelled from the coin sorting passage 8 to the return opening 3 through the return chute 14. The coin returning means is of a type well known in the drop type coin sorting devices and includes a transmitting lever 55 actuated by the returning lever 4 and a cancel pin 56 extending from the transmitting lever 55 through a slot 57 in the stationary side plate 5 to the coin sorting passage 8 so as to engage the semi-spherical point of the cancel pin 56 with a sloped surface 58 formed on the inner wall of the movable side plate 6 (FIG. 14). In the known drop type coin sorting devices, a returning lever is positioned above the transmitting lever 55 so that the transmitting lever is subjected to a depressing force thereon. In the front type coin sorting devices, however, the returning lever 4 is positioned at the midpoint between the coin inserting opening 2 and the return opening 3 and under the transmitting lever 55, as shown in FIG. 5.

Accordingly, in order to move the cancel pin 56 downwardly along the sloped surface 58 so as to open the coin sorting passage downwardly to the return chute 14 by rotating the movable side plate 6 about the hinge pin 7, the transmitting lever 55 is pivoted at a midpoint pivot pin 54 to the stationary side plate 5 and is provided with the cancel pin 56 at one end 55*b* of the opposite free ends 55*a*, 55*b*, and provision is made for an interlocking lever mechanism for transmitting a vertically upward pushing force to the other free end 55*a* of the transmitting lever 55 by a rotational movement of the returning lever 4 about its shaft 50.

Figure 11:
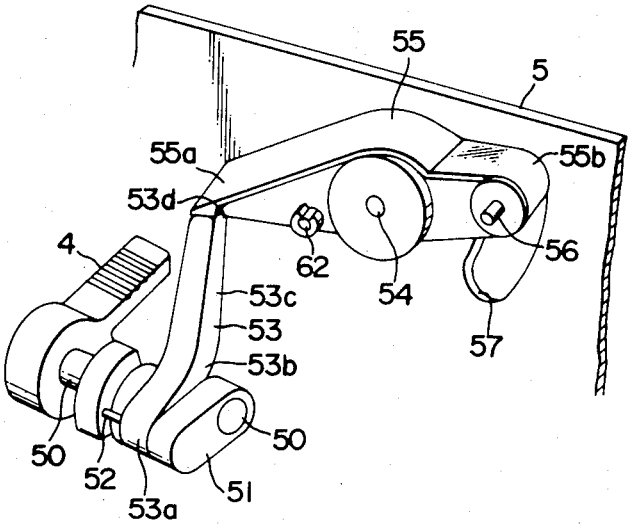
FIG. 11 is a perspective view of the returning lever and its interlocking lever mechanism.

The interlock lever mechanism, shown in FIGS. 11 and 12, includes a crank arm 51 secured to the end portion of the shaft 50 which is extended through the front plate 1 and a flange portion of the side plate 5 (FIG. 5) and is rotatably supported in the through holes (not shown) in the front plate and the flange portion. The crank arm 51 has a crank pin 52 by which a cancel slider 53 is connected at its lower end 53*a* to the crank arm 51. The cancel slider 53 has a curved lower portion 53*b* and a linear upper portion 53*c*. As shown in FIGS. 13 and 14, the lower surface of the free end 55*a* of the transmitting lever 55 is resiliently engaged with the top end 53*d* of the linear upper portion 53*c* of the cancel slider 53 by a downward pushing force of a returning coil spring 63. The coil spring 63 is secured to a hub portion 55*d* of the transmitting lever 55 and is engaged at one end 63*a* thereof with the body of transmitting lever 55 and at the other end 63*b* with a pin 64 on the side plate 5. The transmitting lever 55 made of synthetic resin is provided with a magnet 62 and the side plate 5 made of synthetic resin is provided with a magnetizable iron piece 60 which has its one side face 60*a* exposed to the coin sorting passage 8 from a mounting hole 61 so as to be magnetized by the magnet 62 at the normal position of the transmitting lever 55.

With the above construction of the cancel mechanism, when the returning lever 4 is depressed, as shown by arrow "A" in FIG. 12, the shaft 50 and crank arm 51 are rotated as shown by arrow "B". As a result, the linear upper portion 53*c* of the cancel slider 53 makes a vertical linear movement along the side plate 5, as shown by arrow "C", by means of the crank arm 51, crank pin 52 and curved lower portion 53*b*. The top end 53*d* of the cancel slider 53 pushes the free end 55*a* of the transmitting lever 55 upwardly against the force of the spring 63, and the transmitting lever 55 is then rotated about the pivot pin 54, as shown by arrow "D". The other free end 55*d* is therefore moved downwardly, and the cancel pin 56 slides downwardly on the sloped surface 58 to force open the movable side plate 6 and thereby downwardly open the coin sorting passage 8. At the same time, the magnet 62 on the transmitting lever 55 is displaced from the position registered to the magnetizable piece 60. Therefore, as described below, the non-acceptable coin caught by the cradle 65, magnetized piece 60, hole engaging wire 63 or the like, drops from the coin sorting passage 8 to the return chute 14.

Figure 15:
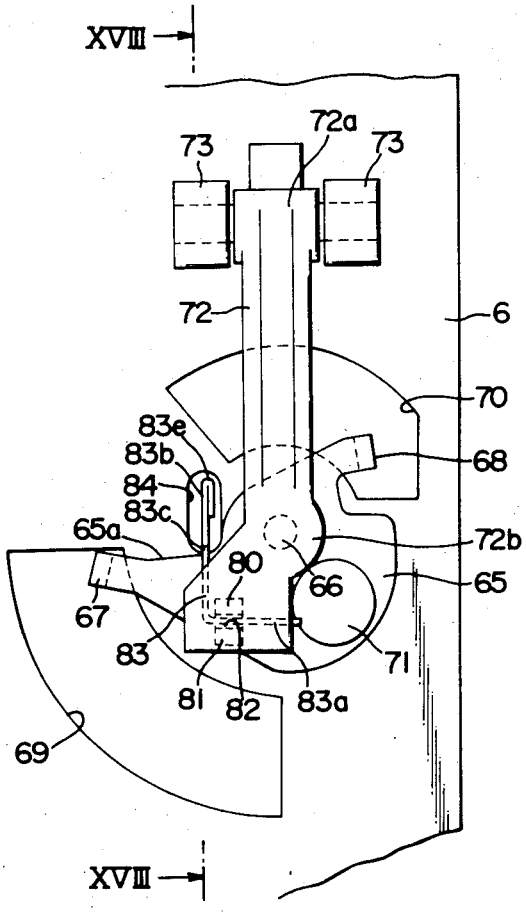
FIG. 15 is a front elevational view of the cradle and cradle holder arm shown in FIG. 1.

Referring to FIG. 1, a cradle 65 for sorting the diameters of coins is pivoted at a pivot pin 66 to the movable side plate 6 and is provided with two engaging lugs 67 and 68, as shown in FIG. 15. The lugs are spaced so as to permit non-acceptable coins smaller than acceptable coins to pass downwardly therebetween into the return chute 14, but to intercept acceptable coins. The engaging lugs 67 and 68 extend into the passage 8 through arch-shaped openings 69 and 70, respectively, formed in the movable side plate 6. The cradle 65 is usually balanced by means of a balance weight 71 in such a position that the inserted acceptable coin is intercepted by both lugs 67 and 68, and the weight of the coin causes the cradle to rock in a clockwise direction to a position where the coin can roll free of the cradle into the inclined rail 11 into the passage 8.

Figure 16:
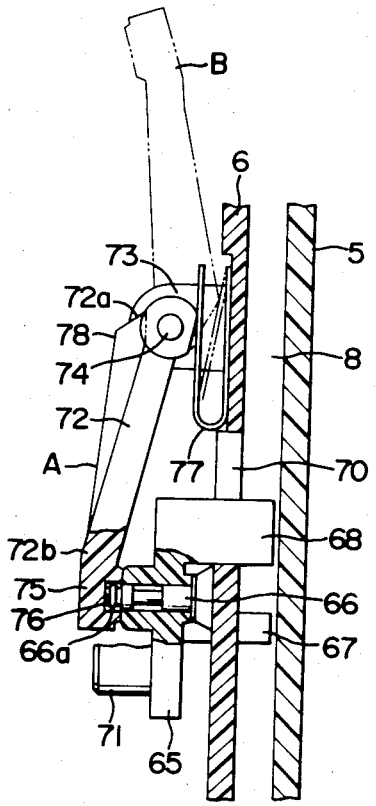
FIG. 16 is a partial sectional view of the cradle and the cradle holder arm of FIG. 15.
Figure 17:
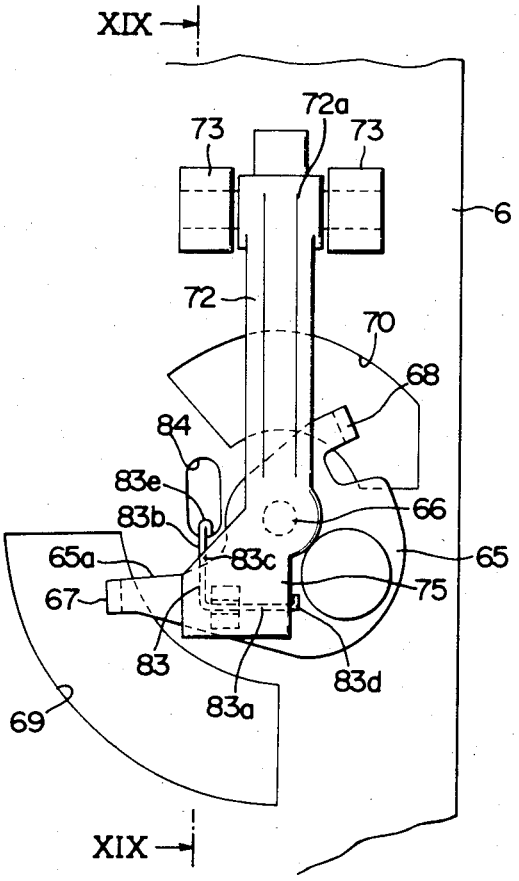
FIG. 17 is a similar view of FIG. 15 showing the cradle rotated at an angle.
Figure 18:
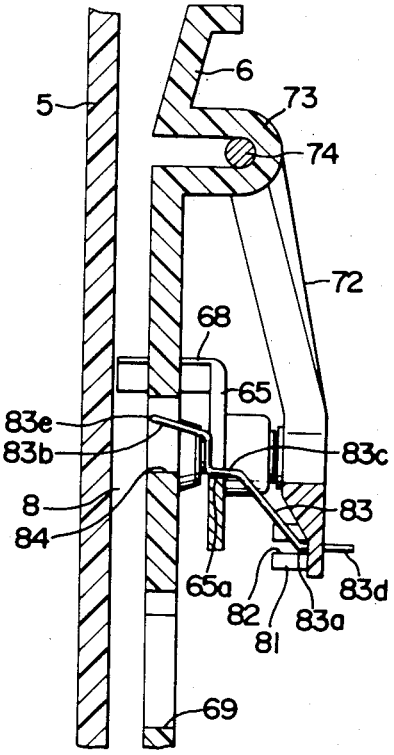
FIG. 18 is a sectional view taken along line XVIII—XVIII of FIG. 15.
Figure 19:
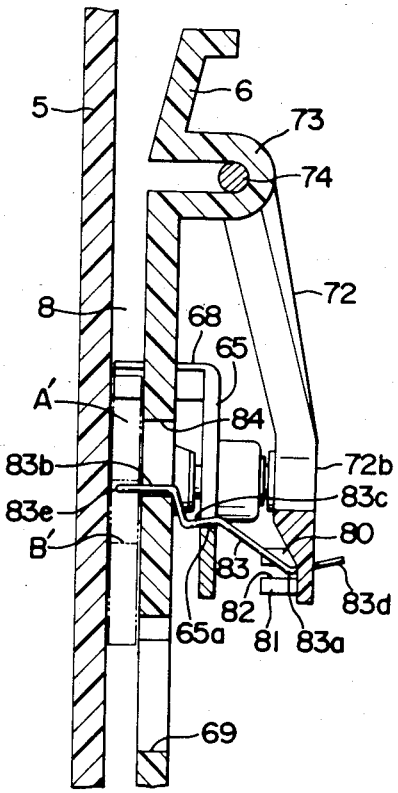
FIG. 19 is a sectional view taken along line XIX—XIX of FIG. 17.

Referring to FIGS. 15 and 16, the cradle 65 is rotatably and removably supported on the pivot pin 66, and is further normally retained on the pivot pin 66 by a holder arm 72. The holder arm 72 is hinged at its upper end 72*a* to the side plate 6 by a hinge pin 74 supported in brackets 73 on the side plate 6, and is usually urged into a cradle holding position "A" (FIG. 16) by means of a spring 77 interposed between the side plate 6 and the upper end 72*a*. The holder arm 72 has at its lower end 72*b* a holder 75 having a hole 76 for receiving the end 66*a* of the pivot pin 66, and at its upper end portion 72*a* a stopper 78 for maintaining the holder arm 72 in the open position "B", as shown in FIG. 16.

With the above construction of the cradle support, if it is necessary to change the cradle 65, the holder arm 72 is rotated upwardly about the hinge pin 74 against the force of the spring 77 from the hold position "A" to the open position "B", whereby the cradle can be pulled off of the pivot pin 66. Thereafter, another cradle can be inserted on the pivot pin 66, and the holder arm 72 is rotated downwardly about the hinge pin 74 to the hold position "A", thereby engaging the holder 75 to the end 66*a* of the pivot pin 66.

Referring to FIGS. 15 and 17–21, the holder 75 is provided with a pair of upper and lower lugs 80 and 81 forming a support channel 82 therebetween for rotatably supporting a coin center hole engaging wire 83. The hole engaging wire 83 has a support portion 83*a* rotatably supported about a horizontal axis in the channel 82, and a cradle engaging middle portion 83*c* extending upwardly and perpendicularly from the support portion 83*a* toward the side plate 6 and being bent so as to engage with the upper edge surface 65*a* of an arm of the lug 67 at the coin roll out side of the cradle 65. A hole engaging end portion 83*b* extends through an opening 84 in the side plate 6 to the passage 8 from the middle portion 83*c* via a vent portion and a latched end portion 83*d* for preventing the wire 83 from shifting away from the operating position.

Figure 20:
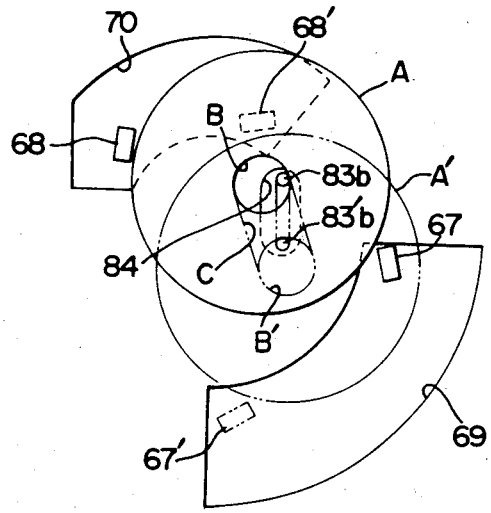
FIG. 20 is a view for illustrating the movement range of the center hole of a coin carried by the cradle.

Referring to FIG. 20, the opening 84 in the side plate 6 is positioned within a zone "C" such that the center hole "B" of a coin "A" intercepted by both lugs 67 and 68 is displaced during the rotation of the cradle.

With the above mentioned construction, when the acceptable coin without a center hole gets on the cradle 65 by being intercepted by both lugs 67 and 68, and the cradle 65 rotates about the pivot pin 66 in the coin delivery direction, the upper edge surface 65*a* of the coin rolls downwardly out of the cradle 65, and the hole engaging end portion 83*b* of the wire 83 engages at the round end 83*e* with the acceptable coin "A" so that the acceptable coin is rolled out by the lug 67 of the cradle 65 onto the rail 11 in the passage 8 without any obstruction from the wire 83.

Figure 21:
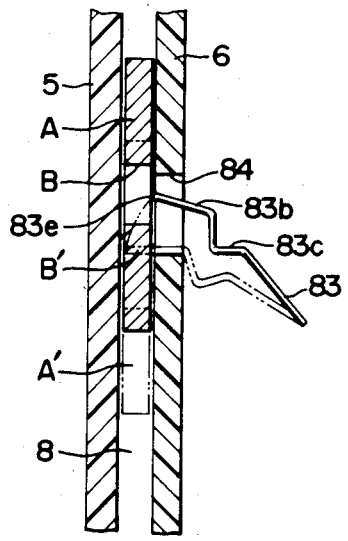
FIG. 21 is a view for illustrating operation of the coin center hole engaging wire shown in FIG. 18.

On the other hand, when a non-acceptable coin "A" having a center hole "B" (FIGS. 20 and 21) gets on the cradle 65, and the cradle 65 rotates about the pivot pin 66 in the coin delivery direction, the upper edge surface 65*a* of the coin rolls out of the cradle as in the case of an acceptable coin, but the hole engaging end portion 83*b* of the wire 83 extends into the center hole "B" of the coin "A" in the passage 8 from the opening 84. As shown in FIG. 21, the upper edge surface 65*a* moves downwardly since the wire 83 is supported at the middle portion 83*c* on the upper edge surface 65*a* and rotates about the horizontal axis of the support portion 83*a* as the upper edge surface 65*a* moves downwardly along with the rotation of the cradle 65. Therefore, the non-acceptable coin "A" having a center hole "B" is caught by the engaging end portion 83*b* and does not roll out of the cradle 65.

The non-acceptable coin thus caught by the wire 83 may be cancelled when the movable side plate 6 is opened downwardly by the operation of the returning lever 4 as mentioned above, and the hole engaging end portion 83*b* is thereby withdrawn from the center hole of the coin.

The above mentioned non-acceptable coin catch operation by the hole engaging wire is completely effective since the coin gets on the cradle and the hole engaging wire is also supported on the cradle such that the locus of the center hole of the coin is maintained in a constant relation to the engaging end portion of the wire.

Figure 22:
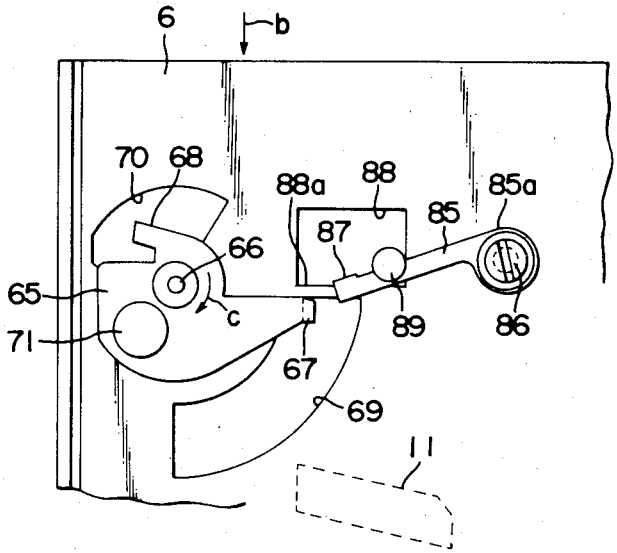
FIG. 22 is a side elevational view of a coin peripheral mill engaging arm.
Figure 23:
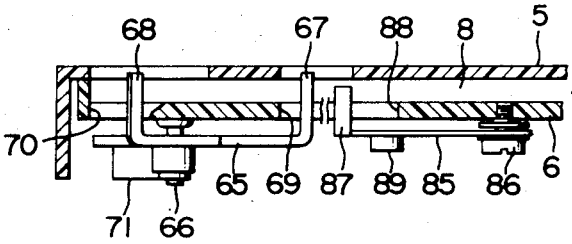
FIG. 23 is a cross-sectional view of FIG. 22.
Figure 24:
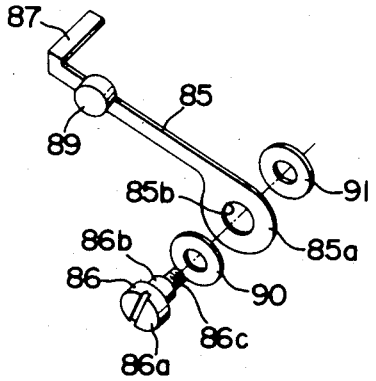
FIG. 24 is an exploded perspective view of the mill engaging arm shown in FIG. 22.

Referring to FIG. 1, a mill engaging arm 85 on the movable side plate 6 is spaced sidewardly from the pivot pin of the cradle 65 for preventing a non-acceptable coin having mills on the outer periphery thereof from passing into the acceptance chute. The mill engaging arm 85 is pivoted at a pivot pin 86 to the side plate 6 and has an engaging thin nail 87 extending from the free end of the arm 85 perpendicularly into the coin sorting passage 8 through an opening 88 formed in the side plate 6, as shown in FIGS. 22 to 24. The arm 85 is provided with a weight 89 near the nail 87 so as to be downwardly inclined toward the lug 67 of the cradle 65 as shown in FIG. 22, and is usually maintained in the inclined position by engagement of the nail 87 with the lower edge 88*a* of the opening 88 so that the nail 87 can engage with a mill on the outer periphery of the non-acceptable coin when the non-acceptable coin is rolled out from the cradle 65 onto the rail 11.

As shown in FIG. 24, the pivot pin 86 for the mill engaging arm 85 has a head 86*a*, shaft portion 86*b* and threaded portion 86*c*. The arm 85 is provided at its pivot end 85*a* with a supporting hole 85*b* having a diameter larger than that of the shaft portion 86*b*. The pivot end 85*a* is loosely mounted on the shaft portion 86*b* together with washers 90 and 91 with a gap in the axial direction so as to rockably support the arm 85 on the shaft 86*b*.

Figure 25:
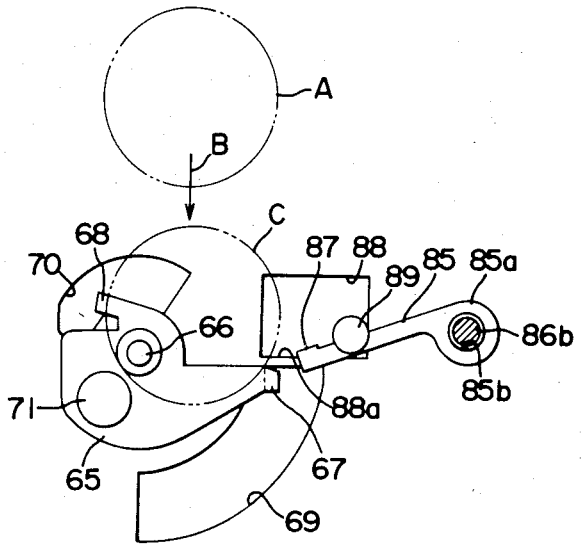
FIGS. 25–27 are views illustrating operation of the mill engaging arm of FIG. 22.
Figure 26:
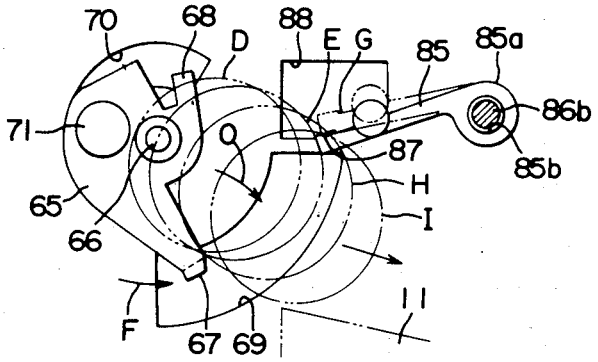

When the mill engaging arm is constructed as mentioned above, the acceptable coin "A" without mills on the outer periphery thereof drops toward the cradle 65, as shown by arrow "B" in FIG. 25, and gets on the cradle 65 as shown by "C". With the rotation of cradle 65 in the delivery direction, the lug 67 is moved to a coin roll out position as shown in FIG. 26. At this point, the coin rolls about a point 67*a* engaged with the lug 67, and the center of the coin is therefore moved as shown by the arrow "O". Thus, at the position "E", the outer periphery of the coin contacts the nail 87. The coin is subjected to a rotational pushing force "F" caused by the weight 71 at the engaging point with the lug 67, and the nail 87 is thereby pushed by the periphery of the coin "E". As a result, the arm 85 is rotated as shown by "G" and the coin rolls out on the rail 11 into the passage 8, as shown by "H" and "I".

Figure 27:
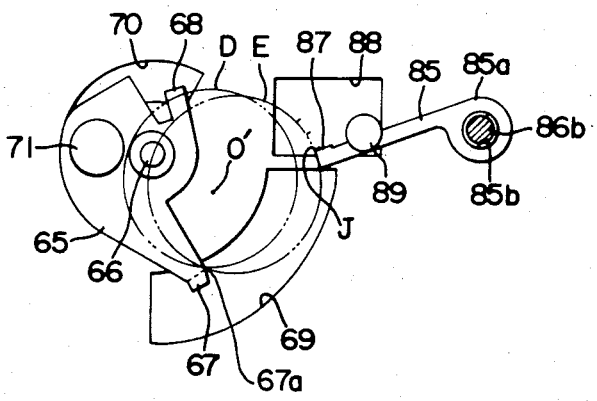
Figure 28:
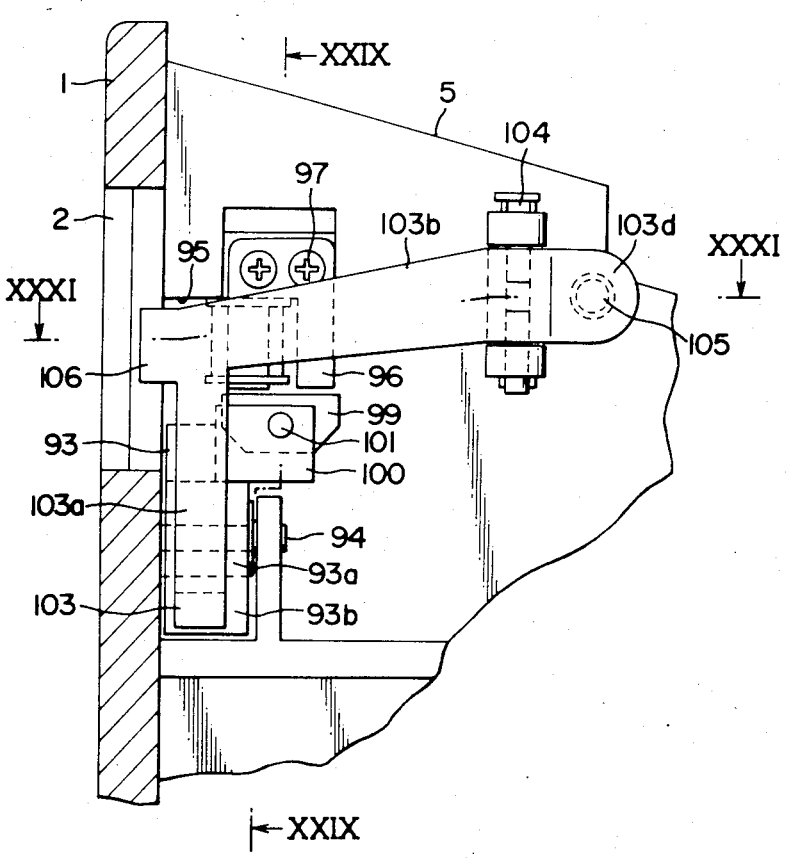
FIG. 28 is an enlarged side elevational view of a blocker at the coin inserting opening.

On the other hand, when a non-acceptable coin having mills on the outer periphery thereof moves from the position "D" to the position "E" on the cradle 65, a mill "J" on the outer periphery is engaged with the nail 87 as shown in FIG. 27. Thus, mill "J" pushes the nail 87 down to the lower edge 88*a* of the opening 88 by a rotational movement of the coin about the point 67*a* engaged with the lug 67, the coin is subjected to an upward rotational force by the lug 67, and the non-acceptable coin is thereby caught by the cradle 65 and the nail 87. The non-acceptable coin thus caught on the cradle can also be cancelled by withdrawing the lugs of the cradle from the coin sorting passage by operating the returning lever or a cancel button.

As shown in FIG. 5, a blocker 92 is provided for preventing a coin from being inserted through the coin inserting opening 2 when automatic vending machines, coin operated game machines or the like are not intended to be used. As shown in FIGS. 28 to 31, the blocker 92 includes a blocker arm 93 having a boss portion 93*a* formed with an integral withdrawing arm 93*b*.

The boss portion 93*a* is rotatably supported on a shaft 94 fixed to the front plate 1 and the side plate 5 so as to extend horizontally and parallel to the side plate 5. The blocker arm 93 extends obliquely and upwardly from the boss portion 93*a* through an opening 95 formed in the side plate 5 to the coin sorting passage 8, and the withdrawing arm 93*b* also extends obliquely and downwardly from the boss portion 93*a* to the side plate 5 such that the blocker arm 93 is rotatable from a withdrawn position during an enabled condition (FIG. 29) to a block position caused by a coin being inserted into the inserting opening during the disabled condition (FIG. 30), wherein the end portion of the blocker arm 93 extrudes through the opening 95 into the inlet portion 8*a* of the coin sorting passage 8 across the lower portion of the opening 2 by its weight.

An electromagnet 96 is provided for holding the blocker arm 93 in the withdrawn position (FIG. 29) out of the passage 8 during an enabled condition of the automatic vending machines or the like. A U-shaped core of the electromagnet 96 is secured to the side plate 5 by means of screws 97 together with a coil 98. A moving iron 99 is movably supported in the vertical direction in a frame 100 by a pin 101 and a slot 102 in the iron 99. The frame 100 is integral with the blocker arm 93 so that in the withdrawn position during the enabled condition, the top end of the iron 99 is aligned with the bottom end of the electromagnet 96 with a small gap. Therefore, the coil 98 of the electromagnet 96 can be energized by a low power such as 5 volts and 10 milliamps (0.05 watt) to attract the iron 99 from a down position of the blocker arm 93 during the disabled condition to an up (withdrawn) position, and to hold the blocker arm 93 in the withdrawn position by the electromagnet 96 during the enabled condition.

Figure 29:
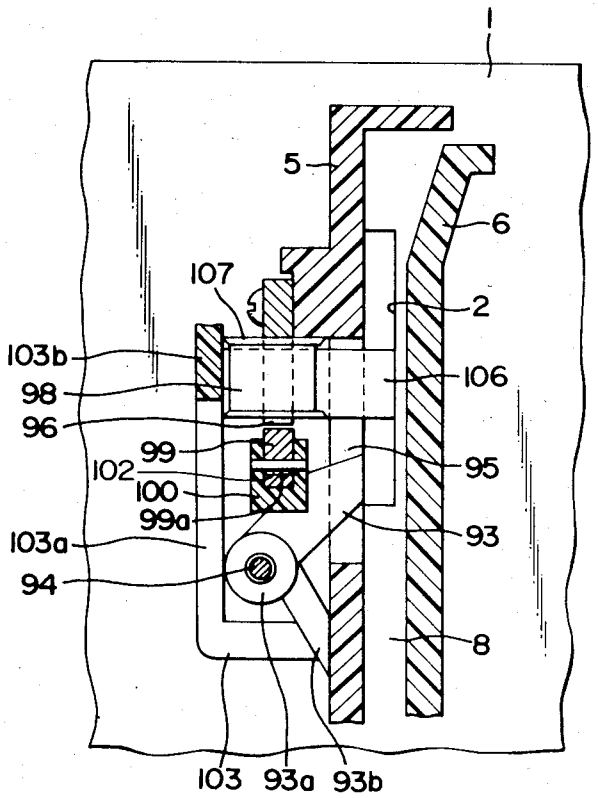
FIG. 29 is a sectional view taken along line XXIX—XXIX of FIG. 28.

In order to hold the blocker arm 93 in the withdrawn position (FIG. 29) during the enabled condition regardless of the imbalance of the blocker arm 93 with respect to the arm 93*b*, iron 99 and frame 100, provision is made for a lock arm 103 to retain the withdrawing arm 93*b* in the withdrawn position of the blocker arm 93, as shown in FIG. 29.

The lock arm 103 has a vertically extending portion 103*a* and a horizontal lever portion 103*b* connected to the upper end of the portion 103*a*. As shown in FIG. 31, the lever portion 103*b* is rotatably supported at 103*c* by a vertical shaft 104 on the side plate 5, and is urged at its end 103*d* by a coil spring 105 interposed between the side plate 5 and the end 103*d* so as to extrude a releasing arm 106 at the opposite end of the lever portion 103*b* into the inlet 8*a* of the coin sorting passage 8 through an opening 95 in the side plate 5 across the coin inserting opening 2. The extrusion of the releasing arm 106 is limited by engagement of the coil frame 107 of the electromagnet 96 and the lever portion 103*b* at 103*e*.

The releasing arm 106 has an inclined surface 108 formed on the front side toward the end so as to produce a sideward and outward force component applied to the inclined surface 108 by a coin intended to be inserted through the coin inserting opening 2, and the lever portion 103*b* is thereby rotated about the shaft 104 to withdraw the arm 106 out of the passage 8.

Figure 30:
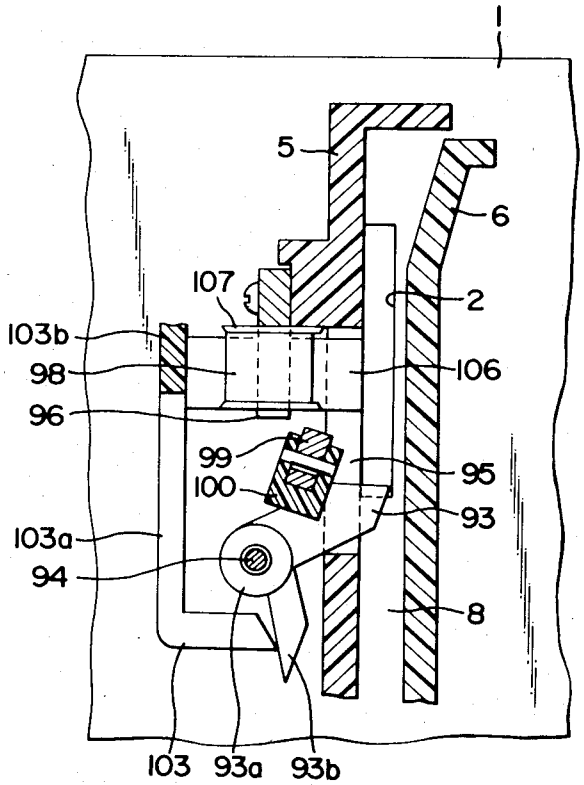
FIG. 30 is a view illustrating operation of the blocker of FIG. 29.

The lock arm 103, at the lower end of the vertical portion 103*a*, is engaged with the withdrawing arm 93*b* so that when the releasing arm 106 extrudes into the passage 8, the lock arm 103 pushes the arm 93*b* against the side plate 5 to lock the blocker arm 93 in the withdrawn position (FIG. 29), and when the releasing arm 106 withdraws out of the passage 8, the lock arm 103 also moves away from the side plate 5 to release the blocker arm 93 (FIG. 30).

With the above construction of the blocker, when the automatic vending machines are not intended to be used and the electromagnet 96 is de-energized, the releasing arm 106 extrudes into the passage 8 and the blocker arm 93 is withdrawn from the passage 8.

In the above condition, when a coin is inserted through the inserting opening 2 and the releasing arm 106 is pushed by the coin, the blocker arm 93 moves from the withdrawn position (FIG. 29) to block position (FIG. 30). When the coin inserting operation ceases, the block condition shown in FIG. 30 is returned to the condition shown in FIG. 29 by the action of the spring 105.

When the electromagnet 96 is energized, the blocker arm 93 is held in the withdrawn position (FIG. 29) by the attractive force of the electromagnet 96 applied to the iron 99. Therefore, when a coin is inserted through the inserting opening 2 and is engaged with the releasing arm 106 to move the lock arm 103 from the lock position to the release position, the blocker arm 93 is maintained in the withdrawn position after the blocker arm has been released, and the inserted coin therefore passes into the coin sorting passage.

The above mentioned blocker has the advantages of making it possible to use a small electromagnet operable by low power such as 0.05 watt so that power consumption is greatly reduced.

What is claimed is:

1. A coin sorting device comprising:

a front plate provided with an opening for inserting a coin, a returning lever and a return opening;

a coin sorting passage defined between a stationary side plate and a movable side plate openably connected to the stationary side plate for receiving coins inserted through the coin inserting opening;

a coin diameter sorting cradle rotatably and removably supported on a pivot pin on one of the side plates of the coin sorting passage;

means arranged along the coin sorting passage for sorting the coins by their material;

a coin acceptance chute and a coin return chute defined between two chute side plates and bifurcating an outlet of the coin sorting passage;

a microswitch having a microswitch actuating arm extending into a lower end of the coin acceptance chute for producing a coin acceptance signal; and a cancel mechanism including the returning lever and means for returning a non-acceptable coin from the coin sorting passage to the return chute;

the coin returning means having:

a transmitting lever pivoted at a midpoint pivot pin to the stationary side plate, the transmitting lever being provided at a first free end with a cancel pin; and an interlocking lever mechanism for transmitting a vertically upward pushing force to a second free end of the transmitting lever by the rotational movement of the returning lever about its shaft;

the interlocking lever mechanism including;

a crank arm secured to an end portion of the returning lever shaft, a cancel slider being connected at its lower end to a crank pin on the crank arm and being engaged at its top end with a lower surface of the second free end of the transmitting lever; and a returning spring for applying a downward pushing force to said second free end of the transmitting lever.

2. A device as claimed in claim 1, further comprising a magnet positioned in the transmitting lever and a magnetizable piece positioned in one of the side plates of the coin sorting passage so as to be normally magnetized by the magnet.

3. A device as claimed in claim 1, further comprising:

a shutter movably arranged across the inlet of the coin acceptance chute for completely closing the inlet of the coin acceptance chute;

a shutter actuating arm adapted for actuating the shutter by engaging with a coin passing in the coin acceptance chute;

a lock lever for locking the microswitch actuating arm; and a releasing arm provided on the shutter for releasing the lock lever at a chute inlet closed position of the shutter.

4. A device as claimed in claim 3, said shutter having a shutter plate slidable in arch-shaped guide grooves formed in both side plates, respectively.

5. A device as claimed in claim 4, said shutter actuating arm being secured to the shutter for adjusting a distance between the shutter actuating arm and the shutter plate corresponding to a diameter of an acceptable coin.

6. A device as claimed in claim 3, said lock lever being rotatably connected in a vertical position to one of the side plates and having engaging portions for engaging upper and lower ends of the microswitch activating arm, respectively.

7. A device as claimed in claim 6, wherein one of the engaging portions is located in a vertically elongated slot formed in the lock lever.

8. A device as claimed in claim 1, further comprising:

a non-acceptable coin block arm pivoted on one of the side plates for extruding into the inlet of the coin acceptance chute;

an actuating lever being pivoted on one of the side plates, and having a coin detecting arm extending into the return chute and a block arm actuating arm engaged with the block arm for pushing the block arm into the inlet of the coin acceptance chute upon detection by the coin detecting arm of a coin in the coin return chute.

9. A device as claimed in claim 8, wherein the coin detecting arm has a movable chute bottom plate at its free end, the bottom plate being lifted up from a bottom of the return chute by action of a balance weight on the actuating lever.

10. A device as claimed in claim 1, further comprising:

a cradle holder capped on a free end of the pivot pin supporting the cradle for retaining the cradle on the pivot pin, the cradle holder being formed at one end of a holder arm which is resiliently hinged at its other end to one of the side plates.

11. A device as claimed in claim 10, further comprising a coin hole engaging wire having a support portion rotatably supported on the cradle holder about a horiziontal axis, a middle portion extending perpendicularly from the support portion and being engaged with an upper edge surface of the cradle at a coin roll out side thereof, and a coin hole engaging end portion extending from the middle portion through an opening in one of the side plates to the coin sorting passage.

12. A device as claimed in claim 1, further comprising:

a mill engaging arm pivoted to the movable side plate at a position sidewardly spaced from the pivot pin of the cradle, an engaging thin nail extending from a free end of the mill engaging arm perpendicularly into the coin sorting passage through an opening formed in the movable side plate, a weight being positioned near the nail so as to engage the free end of the mill engaging arm with a lower edge of said opening in the movable side plate so as to maintain the mill engaging arm in a position inclined downwardly toward a lug at a coin roll out side of the cradle, whereby the nail engages with a mill on the outer periphery of a non-acceptable coin when a non-acceptable coin rolls out from the cradle into a rail in the coin sorting passage.

13. A device as claimed in claim 1, further comprising:

a blocker including a blocer arm being rotatable from a withdrawn position to a block position in which the blocker arm extrudes into the inlet of the coin sorting passage across the coin inserting opening, said blocker arm being provided with an iron piece;

whereby when the blocker arm is positioned in the withdrawn position, an electromagnet in registry with the iron piece, upon being energized, holds the blocker arm in the withdrawn position, a lock arm being engaged with the blocker arm to maintain the blocker arm in the withdrawn position, and a releasing arm being integrally connected to the lock arm and further being resiliently extruded into the inlet of the coin sorting passage so as to be withdrawn by a coin inserted through the coin inserting opening to thereby release the blocker arm.

* * * * *